US005692444A

United States Patent [19]

Claassen et al.

[11] Patent Number: 5,692,444

[45] Date of Patent: Dec. 2, 1997

[54] CLEANING DEVICE FOR USE IN CLEANING A PASTE SUPPLY SYSTEM OF A ROTARY SCREEN PRINTING MACHINE

[75] Inventors: Wilhelmus J.A.L.M. Claassen, Boxmeer; Wilhelmus J.T. Veugelers, Kessel; Henricus G.M. Kempen, Ledeacker, all of Netherlands

[73] Assignee: Stork Brabant B.V., The Netherlands, Netherlands

[21] Appl. No.: 726,767

[22] Filed: Oct. 7, 1996

[30] Foreign Application Priority Data

Oct. 11, 1995 [NL] Netherlands ..... 1001398

[51] Int. Cl.[6] ..... B41F 35/00

[52] U.S. Cl. ..... 101/424; 101/425; 134/169 R

[58] Field of Search ..... 101/424, 423, 101/425; 134/169 R, 169 C

[56] References Cited

U.S. PATENT DOCUMENTS

| | | | |
|---|---|---|---|
| 3,896,730 | 7/1975 | Garrett et al. | 101/364 |
| 4,369,734 | 1/1983 | Preuss | 101/425 |
| 4,526,102 | 7/1985 | Grobman | 101/425 |
| 4,686,902 | 8/1987 | Allain et al. | 101/424 |
| 4,722,273 | 2/1988 | Jahn | 101/425 |
| 5,402,724 | 4/1995 | Yaeso et al. | 101/424 |

FOREIGN PATENT DOCUMENTS 8702417 5/1989 Netherlands .

*Primary Examiner*—Edgar S. Burr
*Assistant Examiner*—Anthony H. Nguyen
*Attorney, Agent, or Firm*—Ladas & Parry

[57] ABSTRACT

The invention relates to a cleaning device for use in cleaning a paste supply system of a rotary screen-printing machine, which paste supply system at least comprises a pump as well as a paste suction line and a paste pressure line, while the cleaning device at least comprises a cleaning agent container, for liquid cleaning agent, by means of which the paste suction line and the paste pressure line can be placed in liquid communication for the purpose of interaction between the paste supply system and the cleaning device, the cleaning device being characterized in that flow-altering means are present. Preferably, the flow-altering means which impart to the cleaning agent, as it flows through the cleaning device and the paste supply system interacting therewith, a direction of flow at least over part of the paste suction line and/or the paste pressure line which has both an axial and a radially outwardly directed velocity component. The advantage of a cleaning system of this kind is that a pump device having a lower pump capacity than was usual hitherto can be used, and in addition lines having a larger cross-section can be effectively cleaned.

14 Claims, 3 Drawing Sheets

CLEANING DEVICE FOR USE IN CLEANING A PASTE SUPPLY SYSTEM OF A ROTARY SCREEN PRINTING MACHINE

BACKGROUND AND SUMMARY OF INVENTION

The invention relates to a cleaning device for use in cleaning a paste supply system of a rotary screen-printing machine, which paste supply system at least comprises a pump as well as a past suction line and a paste pressure line, while the cleaning device at least comprises a cleaning agent container, for liquid cleaning agent, with which the paste suction line and the paste pressure line can be placed in liquid communication for the purpose of interaction between the paste supply system and the cleaning device.

A device of this kind is generally known and, when the paste supply system is being cleaning, consists in stopping the supply of paste to the doctor of a rotary screen-printing machine and preferably placing the paste pressure line in liquid communication with a cleaning agent container containing liquid cleaning agent. In addition, the paste suction line is placed in communication with the cleaning agent container containing liquid cleaning agent, in order in this way to obtain a cleaning system for cleaning the paste supply system which is, if desired, cyclical.

It should additionally be pointed out that it is known per se substantially to clean paste from the paste pressure line by sucking a ball of suitable diameter through this line in the opposite direction to the paste supply direction by means of the pump. However, this does not provide any solution to the problem of cleaning paste residues from the paste suction line.

The drawback of this known system is that extreme demands have to be placed on the pump device present.

Since the print runs of a design which is to be printed are often short, the paste supply system has to be able to be cleaned quickly and often. However, cleaning this system quickly when lines having a relatively large diameter are used presents a problem, and in any case requires a high pump delivery. In addition, the pump device must be able not only to pump the low delivery of paste required during the printing operation but also to pump the high delivery of liquid required during the passage of cleaning liquid.

The object of the invention is to overcome the drawback of this known device.

In addition, the object of the invention is to make it possible to use a pump device having a lower pump capacity than has hitherto being customary in the paste supply system of a rotary screen-printing machine, while nevertheless maintaining a good cleaning action.

This aim is achieved according to the invention in that the cleaning device comprises flow-altering means.

These means change the essentially axial flow through the lines, as a result of which the cleaning action is improved during the passage of cleaning liquid.

Preferably, the flow-altering means comprise means which impart to the cleaning agent, as it flows through the cleaning device and the paste supply system interacting therewith, for the purpose of cleaning, a direction of flow at least over part of the paste suction line and/or the paste pressure line which has both an axial and a radially outwardly directed velocity component.

In this way, a turbulent flow, which will persist over a certain distance in the line, which distance will essentially be determined by the pump capacity in conjunction with the dimensions of the line in question and the viscosity of the medium conveyed, will be formed in the flowing medium. Since a turbulent flow, once it has been generated, will therefore be maintained over a certain distance, the means of generating a radially outwardly directed velocity component in the flowing medium are preferably present at least in the region of the inlet opening of the paste suction line.

The flow-altering means thus generate in the medium during conveyance, and in the flow direction of it, a modified and propagating flow profile.

Expediently, the said flow-altering means are arranged in the cleaning agent container containing the cleaning agent to be conveyed.

In particular, the said flow-altering means may comprise a rotor, the axis of rotation of which, when the flow-altering means are operating, is essentially coaxial with the longitudinal axis over the section of the paste suction line in which the said flow component has to be generated.

It should be pointed out that the rotor will to some extent be driven automatically by the medium conveyed by the action of the pump. Although this does require some pump capacity, this is much less than the capacity required of the pump device for cleaning if a rotor is not present.

According to an attractive embodiment, the flow-altering means comprise a cylindrical body having an external helix, which body has a diameter which is suitable for interacting appropriately with the paste suction line. Due to its simplicity and ease of mounting, an embodiment of this kind provides significant advantages, whilst in addition the formation of a powerful turbulent flow which can be maintained over a long distance is ensured.

According to another preferable embodiment, the said flow-altering means comprise a mandrel having an external helix which can interact with the paste inlet end of the paste suction line.

Of course, it is also possible to arrange a mandrel of this kind at any desired location in the paste suction line, although the cleaning action in that part of the paste suction line which lies upstream of the mandrel is then lower.

In an effective embodiment, the mandrel having an external helix is in the shape of a truncated cone, the smallest diameter of which, when the mandrel is interacting with the paste suction line, can lie inside this line.

In a particularly preferred embodiment of the invention, the paste inlet end of the paste suction line is provided with a conical inlet nozzle having a conicity which corresponds to the conicity of the mandrel and having a length which corresponds to at least part of the length of mandrel.

An embodiment of this kind means that a powerful turbulent flow can be generated in the flowing cleaning agent, which turbulent flow can be maintained over a considerable distance in the paste suction line.

In an alternative embodiment, the said flow-altering means comprise elements which modify the flow profile, are present in the paste suction line and are arranged essentially perpendicular to the inner wall. It should be pointed out that the flow profile formed by these elements does not necessarily have to comprise only one self-propagating turbulent motion, but rather a number of turbulent motions may be formed. The only requirement is that the elements referred to above produce a flow profile which, in addition to an axial component, also has a radially outwardly directed velocity component.

Expediently, the elements modifying the flow profile comprise one or more diaphragms arranged axially at a distance from one another and having a radial length which is shorter than the internal radius of the paste suction line.

According to an attractive variant, the flow-altering means comprise an essentially helical supply device for supplying cleaning agent, which device opens out into the paste suction line.

According to yet another variant, the flow-altering means comprise a supply device for supplying cleaning agent, which device opens out essentially radially into the paste suction line.

BRIEF DESCRIPTION OF THE DRAWINGS

The invention will be described in more detail below with reference to the appended drawing, in which.

DETAILED DESCRIPTION

Figure 1:
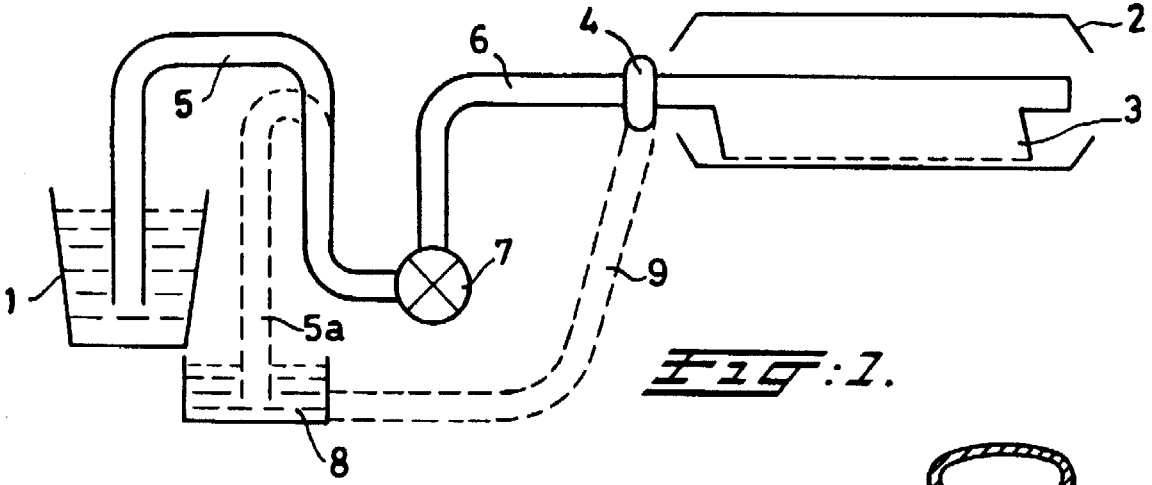
FIG. 1 diagrammatically represents the paste supply system of a rotary screen-printing machine

FIG. 1 diagrammatically represents a paste supply system of a rotary screen-printing machine. More particularly, paste is in this case supplied from a container 1 containing paste via a paste suction line 5, by means of a pump device 7, and then via a paste pressure line 6 to a doctor 3 in a stencil 2 in the rotary screen-printing machine. The paste pressure line 6 is connected to the doctor 3 by means of conventional coupling means 4 which are known per se for this purpose.

It should be noted that when a printing operation has been completed, a different colour will generally then have to be used. This means that the paste supply system has to be cleaned, in order to prevent colours from mixing, which would lead to spoilage.

Success has already been achieved in this context in recovering the paste present in the paste pressure line virtually completely by introducing a rubber ball of a size corresponding to the inside diameter of the paste pressure line into this line from the coupling means 4 and returning the paste present in line 6 to container 1 by means of a sucking action by the pump device 7. However, a system of this kind does not provide any solution for the paste present in the paste suction line 5.

Conventionally, the paste supply system is cleaned by placing the paste suction line 5 in communication with a liquid cleaning agent in a cleaning agent container 8. In this case it is expedient also to place the paste pressure line in liquid communication with the said container containing liquid cleaning agent, whilst implementing a cyclical cleaning process, it being possible for the cleaning agent to circulate through the paste supply system. This situation is depicted diagrammatically in FIG. 1 by paste suction line 5*a*, cleaning agent container 8, and drain 9 for communication between container 8 and pressure line 6.

A cleaning device of this kind has worked well up to now for cleaning the paste supply system of a rotary screen-printing machine in cases where the paste suction line is relatively short and has a small diameter. By way of example, mention may be made of a length of ±1.40 m and an internal diameter of 25 mm.

If longer paste suction lines are used, for example of a length of ±1.80 m, and/or with larger diameters, the cleaning action of the known device has proven clearly inadequate. According to the invention, this problem is overcome by arranging, preferably in the cleaning agent container 8, flow-altering means which, during the flow of the cleaning agent through the paste supply system, impart both an axial and a radially outwardly directed velocity component to the direction of flow in the paste suction line.

In the enclosed drawings, a few suitable embodiments of flow-altering means are depicted. However, it will be clear to the person skilled in the art that the invention is not limited solely to the forms depicted here, but that other means which provide the same effect may also be used.

Figure 2:
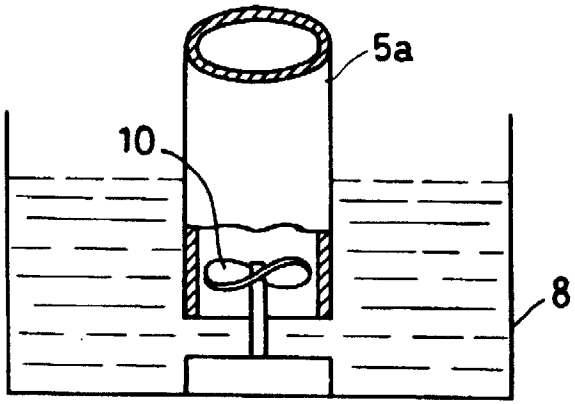
FIG. 2 shows a first embodiment of a flow-altering means according to the invention.

In the embodiment depicted in FIG. 2, the flow-altering means for imparting both a radially outwardly directed flow component and an axial component comprise a rotor 10 which is arranged in container 8, such that its axis of rotation is essentially coaxial with the longitudinal axis of the suction end of the paste suction line. Thus, when the rotor is in operation, a turbulent flow will be formed which will extend through the paste suction line 5, 5*a* as a result of the sucking action of pump device 7. The turbulent flow generated in this manner has a radially outwardly directed velocity component, which results in a greater force being exerted on the inner wall of line 5*a* by the cleaning agent when the cleaning agent is passed through.

Figure 3:
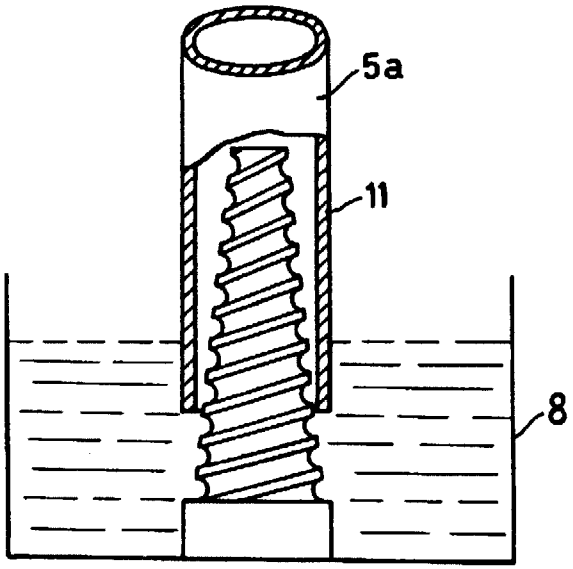
FIGS. 3, 4*a* and 4*b* show preferred embodiments of the flow-altering means according to the invention.

FIG. 3 shows a particularly preferred embodiment of the flow-altering means according to the invention. The embodiment depicted here comprises a mandrel 11 having an external helix which can interact with the paste inlet end of the paste suction line. As is shown in FIG. 3, the mandrel expediently has the shape of a truncated cone.

Figure 4A:
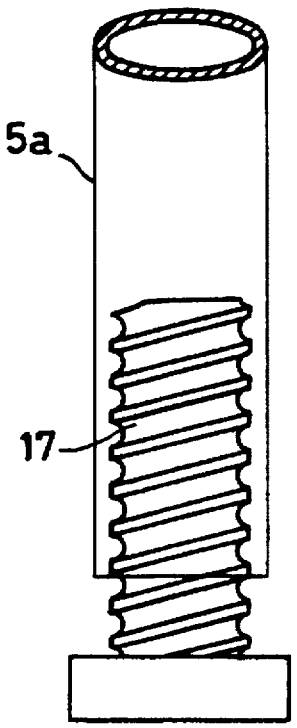

A very efficient embodiment of the flow-altering means according to the invention is depicted in FIG. 4*a*, these flow-altering means comprising a cylindrical body 17 having an external helix, which body has a diameter which is suitable for interacting appropriately with the paste suction line 5. An embodiment of this kind makes it possible for the cylinder provided with a helix to be inserted over its entire length into the paste suction line, thus ensuring that a powerful turbulent flow is produced.

Figure 4B:
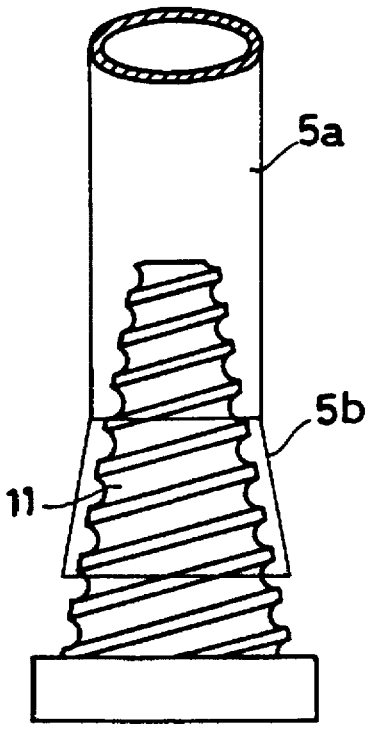

FIG. 4*b* depicts a modification to FIG. 3 which consists in the paste inlet end of the paste suction line 5*a* being provided with a conical nozzle 5*b* which has a conicity which corresponds to the conicity of the mandrel 11 and has a length which corresponds to at least part of the length of mandrel 11.

Figure 5:
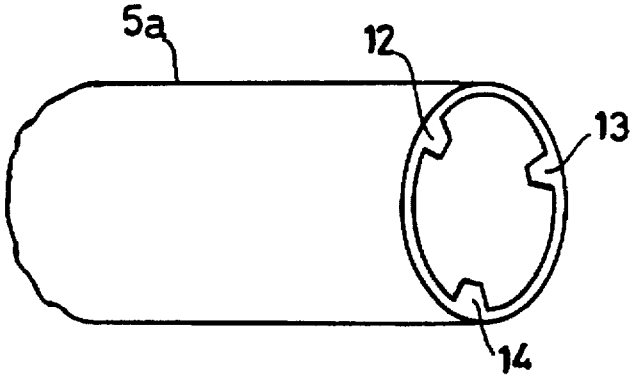
FIGS. 5, 6*a*, 6*b* show alternative embodiments of flow-altering means according to the invention.

FIG. 5 depicts an embodiment of the flow-altering means comprising elements 12, 13, 14 which modify the flow profile, are present on the inner wall of the paste suction line and are arranged essentially perpendicular to the inner wall. Expediently, these elements modifying the flow profile comprise diaphragms arranged at a distance from one another and having a radial length which is shorter than the internal radius of the paste suction line 5*a*. In addition, the diaphragms are expediently arranged staggered in the axial direction with respect to one another.

Figure 6A:
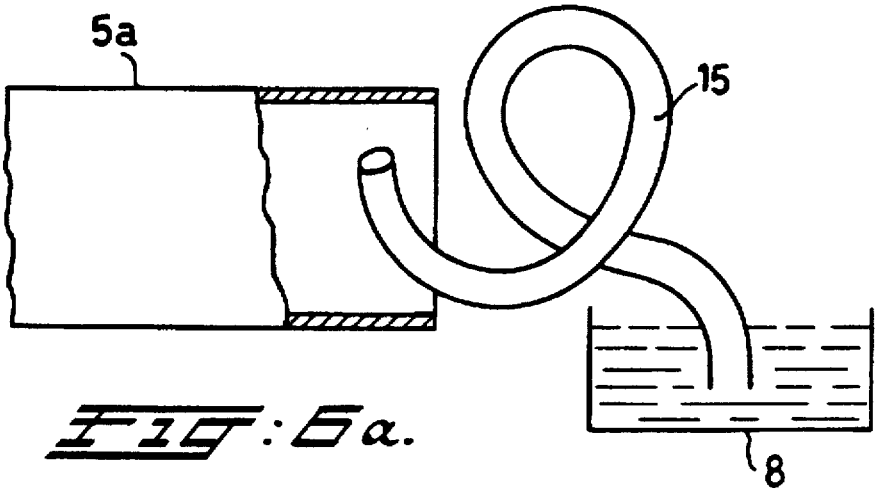

FIG. 6*a* depicts a variant comprising an essentially helical supply device 15, which opens out into the paste suction line, for supplying cleaning agent. It will be clear that a turbulent flow will likewise be formed in the paste suction line in this way.

Figure 6B:
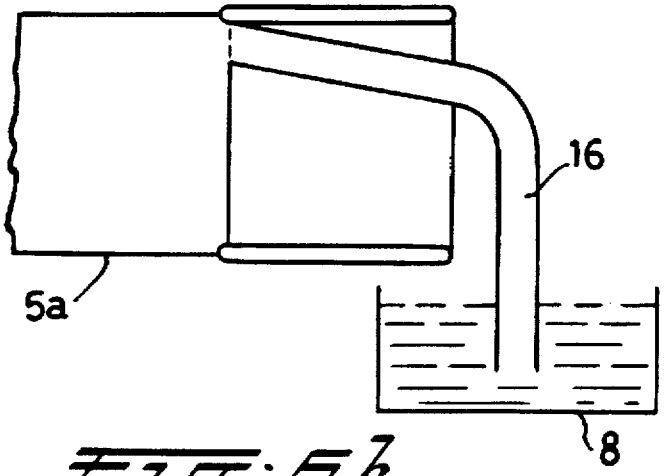

FIG. 6*b* depicts another variant comprising a supply device 16 for supplying cleaning agent, which device opens out essentially radially into the paste suction line (5*a*).

What is claimed is:

1. A cleaning device in combination with a paste supply system of a rotary screen-printing machine, which paste supply system comprises a pump a paste suction line and a paste pressure line, the cleaning device comprising a cleaning agent container for a liquid cleaning agent, and means to connect the paste suction line and the paste pressure line in liquid communication for the purpose of interaction between the paste supply system and the cleaning device, the cleaning device further comprising flow-altering means.

2. A device according to claim 1, wherein the flow-altering means comprise means which impart to cleaning agent, as it flows through the cleaning device and the paste supply system interacting therewith, for the purpose of cleaning, a direction of flow at least over part of the paste suction line (5) and/or the paste pressure line (6) which has both an axial and a radially outwardly directed velocity component.

3. A device according to claim 1, including an inlet opening of the paste suction line, wherein the said flow-altering means are arranged in the region of the inlet opening of the paste suction line (5, 5*a*).

4. A device according to claim 1, wherein the said flow-altering means are arranged in the cleaning agent container (8) containing the cleaning agent to be conveyed.

5. A device according to claim 1, wherein the said flow-altering means comprise a rotor (10), having an axis of rotation which is essentially coaxial with the longitudinal axis of the paste suction line (5*a*).

6. A device according to claim 5, wherein the rotor is arranged preferably in the region of the inlet opening of the paste suction line.

7. A device according to claim 1, wherein the said flow-altering means comprise a cylindrical body (17) having an external helix.

8. A device according to claim 1, wherein the said flow-altering means comprise a mandrel (11) having an external helix.

9. A device according to claim 8, wherein the mandrel (11) is in the shape of a truncated cone, the smallest diameter of which, can lie inside the paste suction line.

10. A device according to claim 9, wherein the paste inlet end of the paste suction line (5*a*) is provided with a conical nozzle (5*b*) having a conicity which corresponds to the conicity of mandrel (11) and having a length which corresponds to at least part of the length of mandrel (11).

11. A device according to claim 1, wherein the said flow-altering means comprise elements which modify the flow profile, are present in the paste suction line (5*a*) and are arranged essentially perpendicular to the inner wall.

12. A device according to claim 11, wherein the elements modifying the flow profile comprise one or more diaphragms (12, 13, 14) arranged axially at a distance from one another and having a radial length which is shorter than the internal radius of the paste suction line (5*a*).

13. A device according to claim 1, wherein the said flow-altering means comprise an essentially helical supply device (15) for supplying cleaning agent, which device opens out into the paste suction line.

14. A device according to claim 1, wherein the said flow-altering means comprise a supply device (16) for supplying cleaning agent, which device opens out essentially radially into the paste suction line.

* * * * *